US005101628A

United States Patent [19]

Yoshino

[11] Patent Number: 5,101,628

[45] Date of Patent: Apr. 7, 1992

[54] ENERGY REGENERATIVE CIRCUIT IN A HYDRAULIC APPARATUS

[75] Inventor: Kazunori Yoshino, Kobe, Japan

[73] Assignee: Shin Caterpillar Mitsubishi Ltd., Tokyo, Japan

[21] Appl. No.: 688,431

[22] Filed: Apr. 22, 1991

Related U.S. Application Data

[62] Division of Ser. No. 641,893, Jan. 16, 1991, Pat. No. 5,046,309.

[51] Int. Cl.[5] ..... F16D 31/02

[52] U.S. Cl. ..... 60/445; 60/452; 60/447; 91/436; 91/461

[58] Field of Search ..... 60/445, 452, 447; 91/436, 461

[56] References Cited

U.S. PATENT DOCUMENTS

| | | | |
|---|---|---|---|
| 3,906,840 | 9/1975 | Bianchetta et al. | 91/461 X |
| 3,935,706 | 2/1976 | Stevens | 60/452 X |
| 4,065,922 | 1/1978 | Ott et al. | 91/444 X |
| 4,293,001 | 10/1981 | Budzich | 91/436 X |
| 4,534,707 | 8/1985 | Mitchell | 60/445 X |
| 4,738,103 | 4/1988 | Tha | 60/452 X |
| 4,967,557 | 11/1990 | Izumi et al. | 60/452 X |

*Primary Examiner*—Edward K. Look
*Assistant Examiner*—Todd Mattingly
*Attorney, Agent, or Firm*—Beveridge, DeGrandi & Weilacher

[57] ABSTRACT

An energy regenerative circuit in a hydraulic apparatus wherein when a direction control valve is at the actuator unloaded-side chamber acting position, the discharge fluid line of a variable displacement pump is connected to a fluid tank via the direction control valve, by-pass fluid line change-over valve and by-pass fluid line that has a signal orifice. The by-pass fluid line is connected to a capacity control mechanism of the variable displacement pump via a signal fluid line on the upstream side of the signal orifice. The loaded-side chamber of the actuator is so connected that the pressurized fluid thereof is partly added through the direction control valve to the fluid line through which the pressurized fluid discharged from the variable displacement pump is fed to the loaded-side chamber. A first pilot valve is connected to the loaded-side chamber via a control fluid line having orifice and is controlled by the pressurized fluid of the loaded-side chamber, the control fluid line being connected to a fluid tank via a return fluid line that is opened and closed by a second pilot valve.

2 Claims, 7 Drawing Sheets

W
224
220
222
244
208
212
238
242
248
250
246
256
254
#15
#16
240
252
258
228
#14
#13
#3
#1
#2
218
#6
#4
#5
226
230
216
#8
#12
#10
#11
232
#9
#7
212
236
214
234
239
210
211
E
G
M
206
204
202
A
(FLOW RATE INCREASES)
B
(FLOW RATE DECREASES)

W
220
224
222
208
244
212
238
266
242
#2
276
#5
226
#14
#16
240
218
230
216
#8
#12
#10
#11
236
232
#9
#7
214
211
G
239
210
206
204
202
A
(FLOW RATE INCREASES)
B
(FLOW RATE DECREASES)

ENERGY REGENERATIVE CIRCUIT IN A HYDRAULIC APPARATUS

This application is a division of application Ser. No. 07/641,893, filed Jan. 16, 1991 now U.S. Pat. No. 5,046,309, issued Sept. 10, 1991.

FIELD OF THE INVENTION

This invention relates to an energy regenerative circuit adapted to a hydraulic apparatus of an operation machine such as an excavator, a crane truck or the like.

DESCRIPTION OF THE PRIOR ART

In an excavator as shown, for example, in FIG. 7, a (front) operation device S consisting of a boom B, an arm A, a bucket B1, hydraulic cylinders C1 and C2, and the like is provided on the main vehicle body H which undergoes the turning motion. The boom B is supported on the main vehicle body H such that it is operated by a boom cylinder C3 which is an actuator. The weight W of the operation device S is exerted on a chamber of the loaded side which is the lower chamber partitioned by a piston of the boom cylinder C3. Here, symbol T denotes a travelling device of the excavator. When the pressurized fluid of a hydraulic pump is to be supplied to a chamber of the unloaded side which is the upper chamber of the boom cylinder C3 in order to lower the boom B, there has been proposed technology for effectively utilizing the potential energy of the operation devices S that acts as a hydraulic pressure (holding pressure) on the chamber of the loaded side as disclosed, for example, in Japanese Laid-Open Utility Model Publication No. 24402/1988.

The above publication discloses a hydraulic circuit of a construction machinery in which a hydraulic line of an actuator on which the load is exerted is coupled to a discharge line of a variable displacement pump whose capacity is controlled by a control mechanism via a change-over valve which is changed over by said control mechanism, wherein a hydraulic circuit with an energy regenerative mechanism of a construction machinery is characterized in that said hydraulic line coupled to the loaded-side chamber of said actuator is provided with an energy regenerative valve which is changed over by said control mechanism when the pressurized fluid in the loaded-side chamber is drained in order to shunt the pressurized fluid drained from the loaded-side chamber and to add it to said hydraulic line of the unloaded-side chamber of said actuator, and a pressure reduction signal valve for reducing the discharge capacity of the pump is provided between said variable displacement pump and said control mechanism.

The above circuit, however, has the following problems that must be solved.

(1) When the holding fluid is regenerated in the loaded-side chamber, the variable displacement pump decreases its discharge rate. However, since the holding fluid having a high pressure in the loaded-side chamber is added to the discharge line of the variable displacement pump and to the hydraulic line of the unloaded-side chamber of the actuator, the discharge pressure inevitably increases. Therefore, the variable displacement pump requires power of [(medium) discharge rate]×[high discharge pressure], and the energy is not necessarily saved.

(2) When the operation device is shifted to the operation for stamping the ground (compacting operation) by, for example, the bottom surface of the bucket at the acting position of the unloaded-side chamber of the actuator, no holding fluid is supplied from the loaded side chamber. At this moment, the variable displacement pump is maintained under a low (medium) discharge rate condition. Therefore, the pressurized fluid is not supplied at a sufficient flow rate into the chamber of the unloaded side, and the operation device fails to exhibit the compacting function to a sufficient degree.

SUMMARY OF THE INVENTION

A first object of this invention is to provide an energy regenerative circuit of an improved hydraulic apparatus which makes it possible to regenerate the holding pressure in the loaded-side chamber of the actuator maintaining high efficiency while greatly saving the energy, and to obtain the compacting function of the operation device sufficiently and stably.

A second object of this invention is to provide an energy regenerative circuit of an improved hydraulic apparatus which makes it possible to regenerate the holding pressure in the loaded-side chamber of the actuator maintaining high efficiency while saving the energy, and to obtain the compacting function of the operation device more quickly and stably.

In order to achieve the above first object, this invention provides an energy regenerative circuit of a hydraulic apparatus comprising a direction control valve that controls an actuator and that is connected to a discharge fluid line of a variable displacement pump controlled by a capacity control mechanism, wherein when said direction control valve is at an actuator unloaded-side chamber acting position:

the discharge fluid line of said variable displacement pump is connected to a fluid tank through a by-pass fluid line change-over valve and a by-pass fluid line that has a signal orifice;

said by-pass fluid line is connected to the capacity control mechanism of said variable displacement pump via a signal fluid line on the upstream side of said signal orifice;

the loaded-side chamber of said actuator is so connected that the pressurized fluid thereof is partly added through said direction control valve to the fluid line through which the pressurized fluid discharged from said variable displacement pump is fed to said unloaded-side chamber;

a first pilot valve is connected to said loaded-side chamber via a control fluid line having an orifice so as to be controlled by the pressurized fluid of said loaded-side chamber;

said control fluid line is connected to a fluid tank via a return fluid line that is opened and closed by a second pilot valve;

said by-pass fluid line change-over valve is constituted to be controlled by said first pilot valve to open said by-pass fluid line when the operation device descends due to its own weight and to close said by-pass fluid line at the time of compacting operation; and said second pilot valve is constituted to be controlled by said first pilot valve to close said return fluid line when said operation device descends due to its own weight and to open said return fluid line at the time of compacting operation.

In order to achieve the above second object, this invention provides an energy regenerative circuit of a hydraulic apparatus, wherein a variable displacement pump controlled by a capacity control mechanism is connected to a fluid tank via a by-pass fluid line and a pilot pump is connected to said fluid tank via an autodeceleration signal fluid line;

the upstream side of orifice of said by-pass fluid line and the downstream side of orifice of said autodeceleration signal fluid line are controlled to be opened or closed when a direction control valve that controls an actuator is at its neutral position or at its operation positions;

the upstream side of said signal orifice of said by-pass fluid line and said capacity control mechanism are connected together via a by-pass pressure signal fluid line, and said pilot pump and said capacity control mechanism are connected together via a pilot pressure transfer fluid line;

a first pilot valve is provided to open and close said by-pass pressure signal fluid line and said pilot pressure transfer fluid line;

said first pilot valve is connected at its pilot port side to the upstream side of said direction control valve of said autodeceleration signal fluid line via an autodeceleration pressure signal fluid line that is opened and closed by the second pilot valve;

said first pilot valve closes said by-pass pressure signal fluid line and opens said pilot pressure transfer fluid line when said direction control valve is at the unloaded-side chamber acting position but only when said autodeceleration pressure signal fluid line is opened by said second pilot valve; and when said direction control valve is at the unloaded-side chamber acting position, the loaded-side chamber of said actuator is so connected that the pressurized fluid thereof is partly added through said direction control valve to the fluid line through which the pressurized fluid discharged from said variable displacement pump is partly fed to said unloaded-side chamber.

Other objects of the invention will become obvious from the following detailed description of embodiments of the energy regenerative circuit of a hydraulic apparatus constituted according to the invention, with reference to the accompanying drawings.

DETAILED DESCRIPTION OF THE PREFERRED EMBODIMENTS

The energy regenerative circuit of the hydraulic apparatus improved according to this invention will now be described in detail by way of embodiments by referring to the accompanying drawings.

Figure 1:
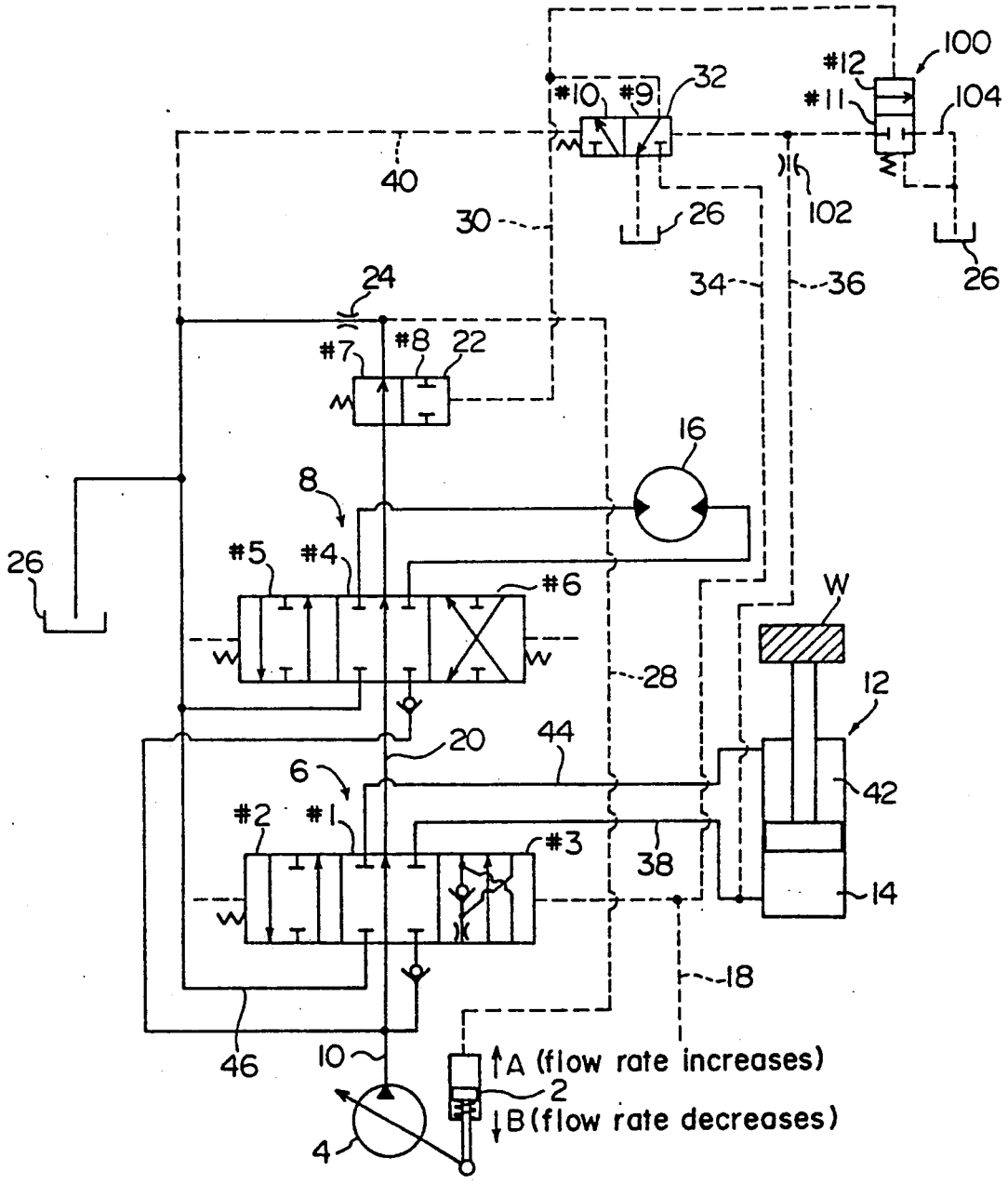
FIG. 1 is a diagram of an embodiment of an energy regenerative circuit of a hydraulic apparatus improved according to this invention in order to accomplish the aforementioned first object.
Figure 2:
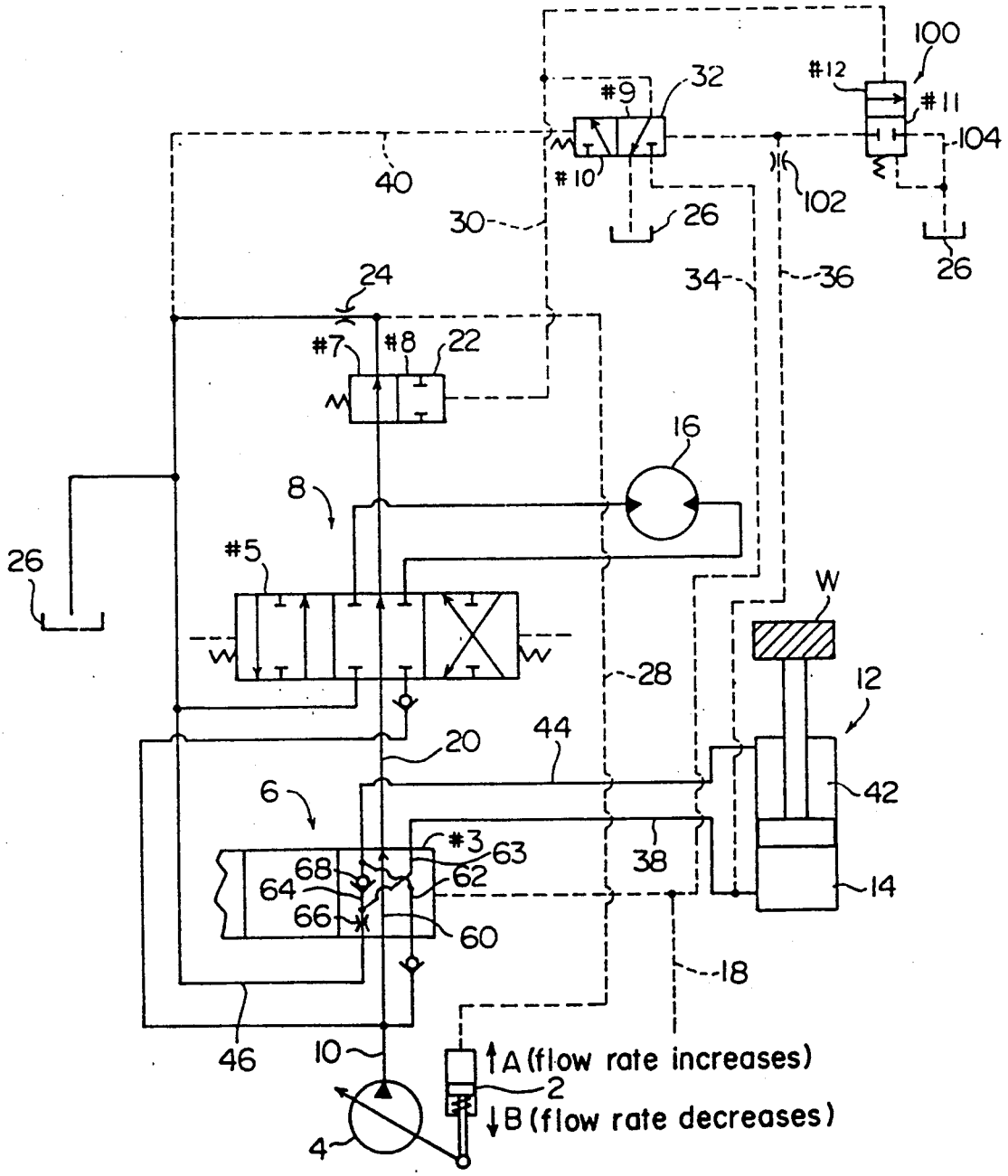
FIGS. 2 and 3 are diagrams illustrating other operation modes of FIG. 1.
Figure 3:
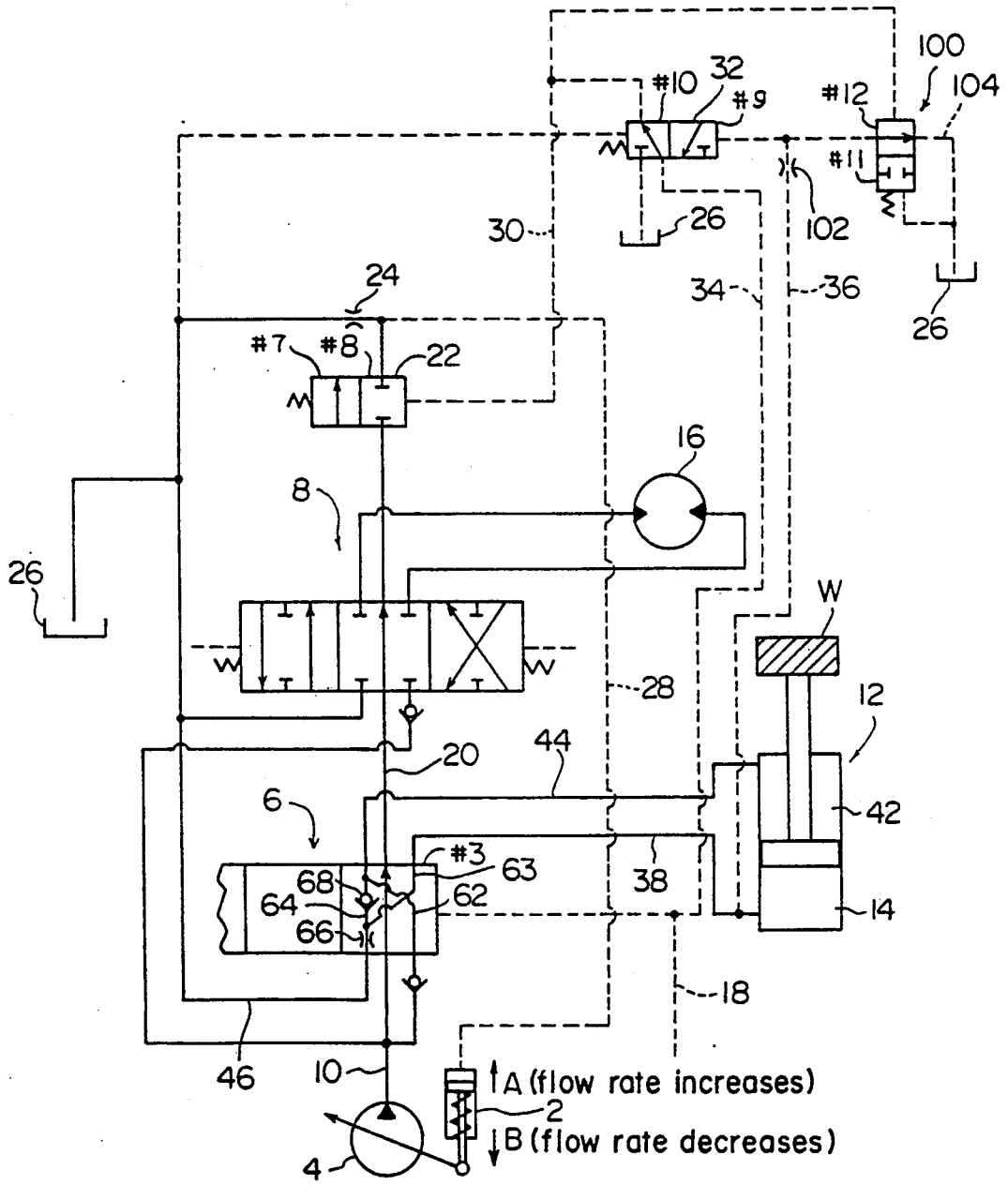

First, described with reference to FIGS. 1 to 3 is an embodiment of the energy regenerative circuit of the hydraulic apparatus improved according to this invention in order to accomplish the above-mentioned first object.

Figure 7:
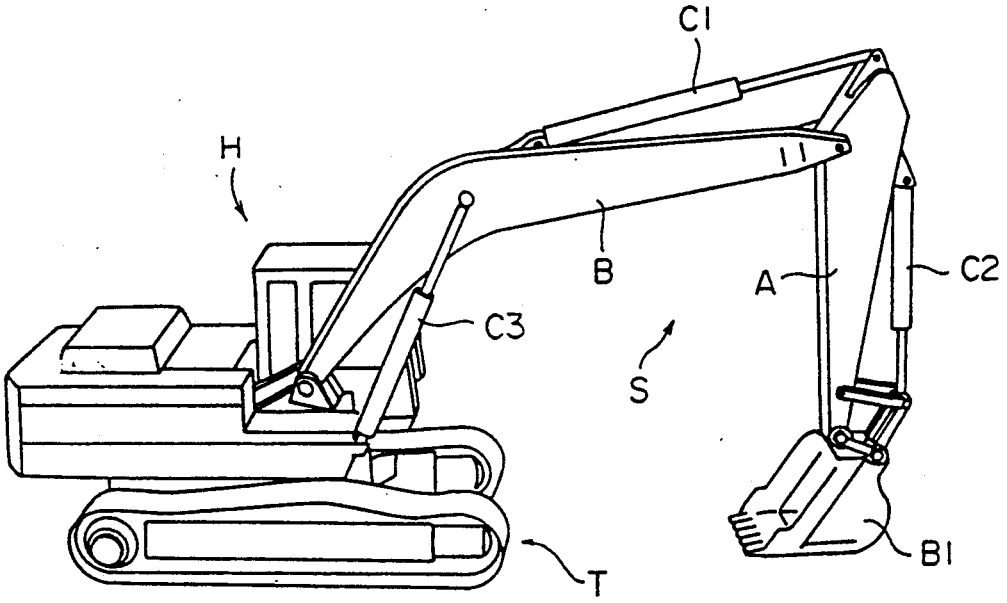
FIG. 7 is a perspective view which schematically shows an excavator to which this invention is adapted.

FIG. 1 illustrates an energy regenerative circuit portion of the hydraulic apparatus which is adapted to, for example, the excavator shown in FIG. 7. A variable displacement pump 4 whose discharge rate is controlled by a capacity control mechanism 2, a direction control valve 6, and another direction control valve 8, are connected together through a discharge fluid line 10. The direction control valve 6 is provided to control an actuator 12. Here, the actuator 12 consists of a boom cylinder C3, and its piston rod supports the load W of the operation device S such as boom B, etc. The load W acts on a chamber 14 of the loaded side as a load-holding pressure (when the operation device S is above the ground).

Another direction control valve 8 is provided to control another actuator 16 which, in this case, consists of a hydraulic motor of a turning device of the excavator. The direction control valve 6 changes over its position being controlled by a secondary pilot pressure of a reducing valve that is not shown but that is connected through a pilot fluid line 18. The other direction control valve 8 changes over its position, too, being controlled by the secondary pilot pressure from the other reducing valve. These reducing valves are controlled by an operation lever provided in the cab.

The direction control valve 6 consists of a 6-port 3-position change-over valve, and can be changed over to a neutral position designated at #1, an actuator loaded-side chamber acting position designated at #2, and an actuator unloaded-side chamber acting position designated at #3. The other direction control valve 8 consists of a 6-port 3-position change-over valve, and can be changed over to a neutral position #4, a hydraulic motor forward rotation position #5 and a hydraulic motor reverse rotation position #6.

Described below are the constitution and function of the hydraulic circuit at each of the positions of the direction control valve 6.

Neutral Position

The direction control valve 6 is at the position designated at #1 in FIG. 1.

The pressurized fluid in the variable displacement pump 4 is discharged into the fluid tank 26 through the discharge fluid line 10, by-pass fluid line 20, other direction control valve 8 provided in the by-pass fluid line 20, by-pass fluid line change-over valve 22, and signal orifice 24.

The pressurized fluid of the by-pass fluid line 20 is further supplied to the capacity control mechanism 2 of the variable displacement pump 4 via a signal fluid line 28 on the upstream side of the signal orifice 24. The capacity control mechanism 2 consists of a capacity control cylinder, and is controlled to move toward the direction of small flow rate indicated by arrow B when the hydraulic pressure supplied to the signal fluid line 28 is great, and to move toward the direction of large flow rate indicated by arrow A when the hydraulic pressure is small. At this neutral position, the hydraulic pressure supplied to the signal fluid line 28 becomes the greatest owing to the function of the signal orifice 24, and the discharge rate of the variable displacement pump 4 is controlled to become the smallest. That is, the variable displacement pump 4 is under the unloaded condition. No pressurized fluid is supplied to the actuator 12.

The by-pass fluid line change-over valve 22 consists of a 2-port 2-position change-over valve, and its pilot port side is connected to the pilot fluid line 18 or the fluid tank 26 via a fluid line 30 and the first pilot valve 32, and is further connected to the pilot port side of the second pilot valve 100.

The first pivot valve 32 consists of a 3-port 2-position change-over valve, and its one pilot side is connected to the loaded-side chamber 14 of the actuator 12 (or is connected, in a concrete embodiment, to a fluid path 38 that connects the loaded-side chamber 14 and the direction control valve 6 together) via the control fluid line 36 having an orifice 102. The other pilot side thereof is connected to the downstream side of the signal orifice 24 of the by-pass fluid line 20 via the fluid line 40. The control fluid line 36 that connects the loaded-side chamber 14 and the first pilot valve 32 together, is further connected to the fluid tank 26 on the downstream side of the orifice 102 via second pilot valve 100 and return fluid line 104.

Therefore, the first pilot valve 32 is controlled by the pressurized fluid of the loaded-side chamber 14 of the actuator 12. The by-pass fluid line change-over valve 22 is controlled by the first pilot valve 32 so as to open and close the by-pass fluid line 20. The second pilot valve 100 is controlled by the first pilot valve 32 so as to control the return fluid line 104.

When the operation device is suspended in the air and the load W acts as a holding pressurized fluid on the loaded-side chamber 14 of the actuator 12, the first pilot valve 32 at its neutral position is leftwardly shifted to a position designated at #9 as shown in FIG. 1 overcoming the tank line pressure of the fluid line 40 and the resilient force. The fluid line 30 that controls the by-pass fluid line change-over valve 22 and the second pilot valve 100, is connected to the fluid tank 26. The by-pass fluid line change-over valve 22 assumes the position designated at #7 to open the by-pass fluid line 20, and the second pilot valve 100 assumes the position designated at #11 to close the return fluid line 104.

When the operation device is on the ground with the second pilot valve 100 at its neutral position, the holding pressurized fluid does not act (pressure is zero) on the loaded-side chamber 14. Therefore, the tank line pressure of the fluid line 40 and the resilient force cause the first pilot valve 32 to be rightwardly shifted in FIG. 1 to assume the position designated at #10. The fluid line 30 is connected to the pilot fluid line 18 via fluid line 34. However, since the secondary pilot pressure has been dropped in the pilot fluid line 18, the by-pass fluid line change-over valve 22 remains under the condition where the by-pass fluid line 20 is kept opened as designated at #7, and the second pilot valve 100 remains under the condition where the return fluid line 104 is kept closed as designated at #11.

Actuator Loaded-Side Chamber Acting Position

The direction control valve 6 is shifted to a position #2.

An internal fluid line that connects the discharge fluid line 10 and the by-pass fluid line 20 together is closed. The pressurized fluid that serves as a flow rate control signal in the signal fluid line 28 is returned to the oil tank 26 via the signal orifice 24, and the signal pressure becomes zero. The capacity control mechanism 2 is controlled to move toward the direction of large flow rate indicated by arrow A, whereby the discharge rate of the variable displacement pump 4 becomes the greatest to establish the loaded condition. The above pressurized fluid is supplied from the discharge fluid line 10 to the loaded-side chamber 14 of the actuator 12 via fluid line 38, and the pressurized fluid in the unloaded-side chamber 42 is returned into the fluid tank 26 via fluid line 44 and return fluid line 46. The pressurized fluid of the variable displacement pump 4 is further fed to the control fluid path 36 via fluid line 38, but causes no problem since the return fluid line 104 has been closed by the second pilot valve 100.

The hydraulic pressure in the control fluid line 36 increases as the pressurized fluid discharged from the variable displacement pump 4 is fed into the loaded-side chamber 14, whereby the first pilot valve 32 is shifted to the position #9 of FIG. 1. The by-pass fluid line change-over valve 22 and the second pilot valve 100 are positioned under the condition shown in FIG. 1 due to the above-mentioned reasons.

Therefore, the boom B, i.e. the operation device S, is ascended.

Actuator Unloaded-Side Chamber Acting Position (When the Boom is Lowered Due to its Own Weight)

The direction control valve 6 is shifted to a position designated at #3 in FIG. 2 upon receipt of the secondary pilot pressure from a reducing valve that is not shown via pilot fluid line 18.

The discharge fluid line 10 and the by-pass fluid line 20 are connected together through an internal fluid line 60 provided in the direction control valve 6. The discharge fluid line 10 is further connected to another internal fluid line 62 provided in the direction control valve 6. The internal fluid line 62 is connected to a further internal fluid line 64, and is connected to the unloaded-side chamber 42 of the actuator 12 via fluid line 44. The internal fluid line 64 is provided with an orifice 66 and a check valve 68. The load-side chamber 14 of the actuator 12 is connected to a point between the orifice 66 and the check valve 68 of the internal fluid line 64 via the fluid line 38 and a further internal fluid line 63 provided in the direction control valve 6. The internal fluid line 64 is connected to the fluid tank 26 via the orifice 66 and return fluid line 46. The internal fluid line 62 is connected to the check side of check valve 68 of the internal fluid line 64.

Next, described below with reference to FIG. 2 is the operation of the energy regenerative circuit with the direction control valve 6 at the actuator unloaded-side chamber acting position designated at #3 (boom is lowered due to its own weight).

The pressure of the holding fluid increases in the loaded-side chamber 14 of the actuator due to the load W of the operation device S, and the first pilot valve 32 is leftwardly shifted (to a position designated at #9). The by-pass fluid line change-over valve 22 assumes the position designated at #7 to open the by-pass fluid line 20. The second pilot valve 100 assumes the position designated at #11 to close the return fluid line 104.

With the by-pass fluid line 20 being opened by the by-pass fluid line change-over valve 22, the pressurized fluid of the variable displacement pump 4 is discharged into the fluid tank 26 through discharge fluid line 10, internal fluid line 60, by-pass fluid line 20, direction control valve 8, by-pass fluid line change-over valve 22, and signal orifice 24. The pressurized fluid of the variable displacement pump 4 is further supplied to the capacity control mechanism 2 from the by-pass fluid line change-over valve 22 through signal fluid line 28. Due to the function of the signal orifice 24, the flow rate-control signal pressure of the signal fluid line 28 becomes the greatest and acts continuously upon the capacity control mechanism 2. Therefore, the capacity control mechanism 2 is controlled to assume a position where the discharge rate becomes the smallest, and the discharge rate of the variable displacement pump 4 is controlled to become the smallest. The variable displacement pump 4 is placed under the unloaded condition.

The load-holding fluid of the loaded-side chamber 14 is supplied to the internal fluid line 64 via fluid line 38 and internal fluid line 63 in the direction control valve 6. The load-holding fluid that is fed passes through the orifice 66 of the internal fluid line 64 and is returned to the fluid tank 26 via return fluid line 46. The load-holding fluid is further partly fed to the unloaded-side chamber 42 of the actuator 12 via check valve 68 of the internal fluid line 64 and fluid line 44.

Thus, the boom 8, i.e. the operation device S, is permitted to descend.

When the other direction control valve 8 is changed over to, for example, the position #5 for forwardly rotating the hydraulic motor 16 and is operated simultaneously with the actuator 12 under the condition where the direction control valve 6 is at the actuator unloaded-side chamber acting position, then the by-pass fluid line 20 is closed. The flow rate-control signal pressure drops to zero in the signal fluid line 28. The capacity control mechanism 2 is controlled to assume the position where the flow rate becomes the greatest, and the discharge rate of the variable displacement pump 4 becomes the greatest. The variable displacement pump 4 establishes the loaded condition. Therefore, excess of fluid of the variable displacement pump 4 without including the pressurized fluid required by the actuator 12, is fed to the other actuator, i.e., to the hydraulic motor 16. That is, the potential energy of the operation device acting on the loaded-side chamber 14 of the actuator 12 is fed to the discharge line of the variable displacement pump 4 that is working as a source of hydraulic pressure at its maximum flow rate.

Actuator Unloaded-Side Chamber Acting Position (During the Compacting Operation)

After the boom is lowered and grounded, the pressurized fluid may often be fed to the unloaded-side chamber 42 of the actuator 12 in order to compact the ground by the operation device.

When the boom is lowered and grounded, the unloaded-side chamber 42 is converted into the loaded side. The hydraulic pressure in the loaded-side chamber 14 is so lowered as to become equal to the line pressure of the fluid tank 26. At a result, the hydraulic pressure of the control fluid line 36 decreases, and the first pilot valve 32 is rightwardly shifted by the resilient force as shown in FIG. 3 to assume the position designated at #10. The secondary pilot pressure of the pilot fluid line 18 acts on the side of pilot port of the by-pass fluid line change-over valve 22 and the second pilot valve 100 through fluid line 34, first pilot valve 32 and fluid line 30.

The by-pass fluid line change-over valve 22 is leftwardly shifted to the position #8 in the drawing to close the by-pass fluid line 20. The flow rate control signal pressure drops to zero in the signal fluid line 28. The capacity control mechanism 2 is controlled to assume the position of the greatest flow rate, and the discharge rate of the variable displacement pump 4 becomes the greatest to establish the loaded condition. When the operation device is in compacting operation, therefore, the pressurized fluid is fed to the unloaded-side chamber 42 at the maximum discharge rate maintaining high discharge pressure.

The second pilot valve 100 is downwardly shifted to assume the position #12 in the drawing thereby to open the return fluid line 104. The control fluid line 36 is connected to the fluid tank 26. As the compacting operation proceeds and the compacting speed becomes high, the fluid pressure increases in the loaded-side chamber 14. Therefore, the fluid pressure increases in the control fluid line 36, but the pressure on the downstream side of the orifice 102 of the control fluid line 36 is maintained at the tank line pressure in the tank 26 due to the function of the orifice 102 and the opening of the fluid line 104. Therefore, despite the compacting speed becomes high and the hydraulic pressure increases in the loaded-side chamber 14, the first pilot valve 32 is not affected but is held at the position #10 in FIG. 3.

Under the condition of FIG. 3, if the pressure-reducing valve that is not shown is returned to the neutral position, the secondary pilot pressure decreases in the pilot fluid line 18 and the hydraulic pressure in the fluid line 30 decreases, too. Then, the second pilot valve 100 is returned to the position #11 to close the connection between the control fluid line 36 and the fluid tank 26. The direction control valve 6 returns to the neutral position designated at #1 in FIG. 1; i.e., there is no blow-by of the pressurized fluid from the orifice 102 of the control fluid line 36, the actuator 12 is locked, and there exists no problem.

The following effects are obtained by the energy regenerative circuit of the hydraulic apparatus that is improved according to this invention in order to achieve the first object mentioned earlier.

(1) When the direction control valve is at the actuator unloaded-side chamber acting position (the boom, i.e., the operation device is lowered due to its own weight), the discharge rate of the variable displacement pump becomes the smallest due to the function of the signal orifice thereby to establish the unloaded condition. Therefore, the variable displacement pump is operated requiring the power [low minimum) discharge rate]×[-low discharge pressure], and the energy can be saved to a very high degree. Moreover, a highly pressurized fluid which is part of the load-holding pressurized fluid of the loaded-side chamber is fed to the unloaded-side chamber of the actuator, and the operation device is permitted to descend sufficiently due to its own weight, and no vacuum condition develops in the unloaded-side chamber.

Therefore, it is allowed to very effectively regenerate the load-holding pressure in the loaded-side chamber, and to save the energy to a striking degree without decreasing the descending speed of the actuator.

(2) When the operation device is shifted to the compacting operation at the unloaded-side chamber acting position of the actuator, the first pilot valve changes over the position of the by-pass fluid line change over valve to close the by-pass fluid line. Therefore, the variable displacement pump establishes the loaded condition where its discharge rate is a maximum.

Therefore, even though the holding fluid is not fed to the unloaded-side chamber from the loaded-side chamber, the pressurized fluid is fed to the unloaded-side chamber from the variable displacement pump at the maximum discharge rate, and the operation device exhibits the compacting function to a sufficient degree.

(3) As the compacting operation proceeds, the compacting speed becomes high and the hydraulic pressure increases in the loaded-side chamber, then the hydraulic pressure increases in the control fluid line which may cause the first pilot valve to be shifted. However, due to the function of the orifice provided in the control fluid line and the opening of the return fluid line by the second pilot valve, the pressure on the downstream side of the orifice of the control fluid line is maintained at the tank line pressure in the tank. Accordingly, despite the compacting speed increases and the hydraulic pressure increases in the loaded-side chamber, the first pilot valve is not affected but is maintained at the same position. Therefore, the by-pass fluid line change over valve is maintained under the condition where the by-pass fluid line is closed, and the compacting operation is carried out very stably.

Figure 4:
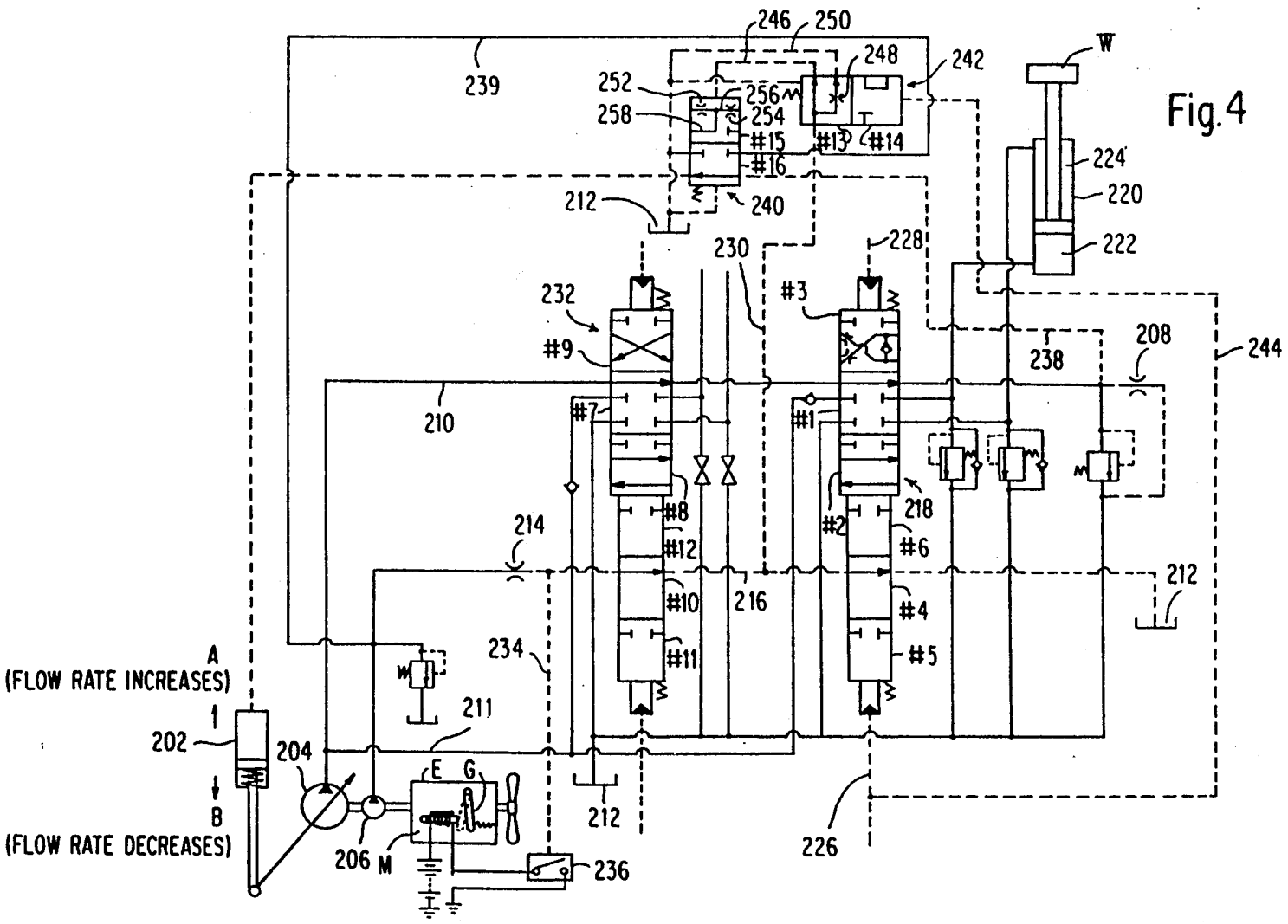
FIG. 4 is a diagram illustrating another embodiment of the energy regenerative circuit of a hydraulic apparatus improved according to this invention in order to accomplish the aforementioned second object.
Figure 5:
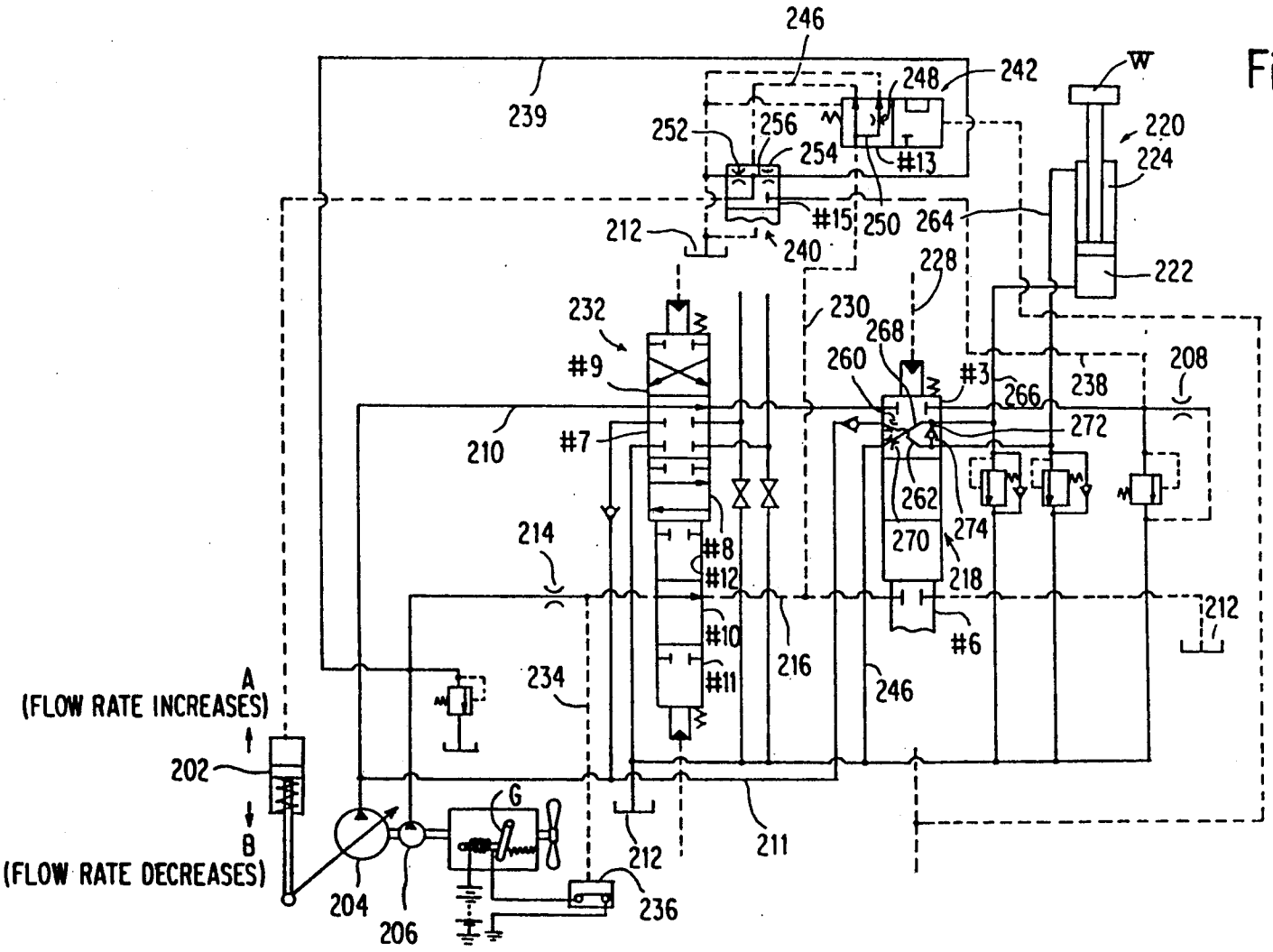
FIGS. 5 and 6 are diagrams illustrating other operation modes of FIG. 4.
Figure 6:
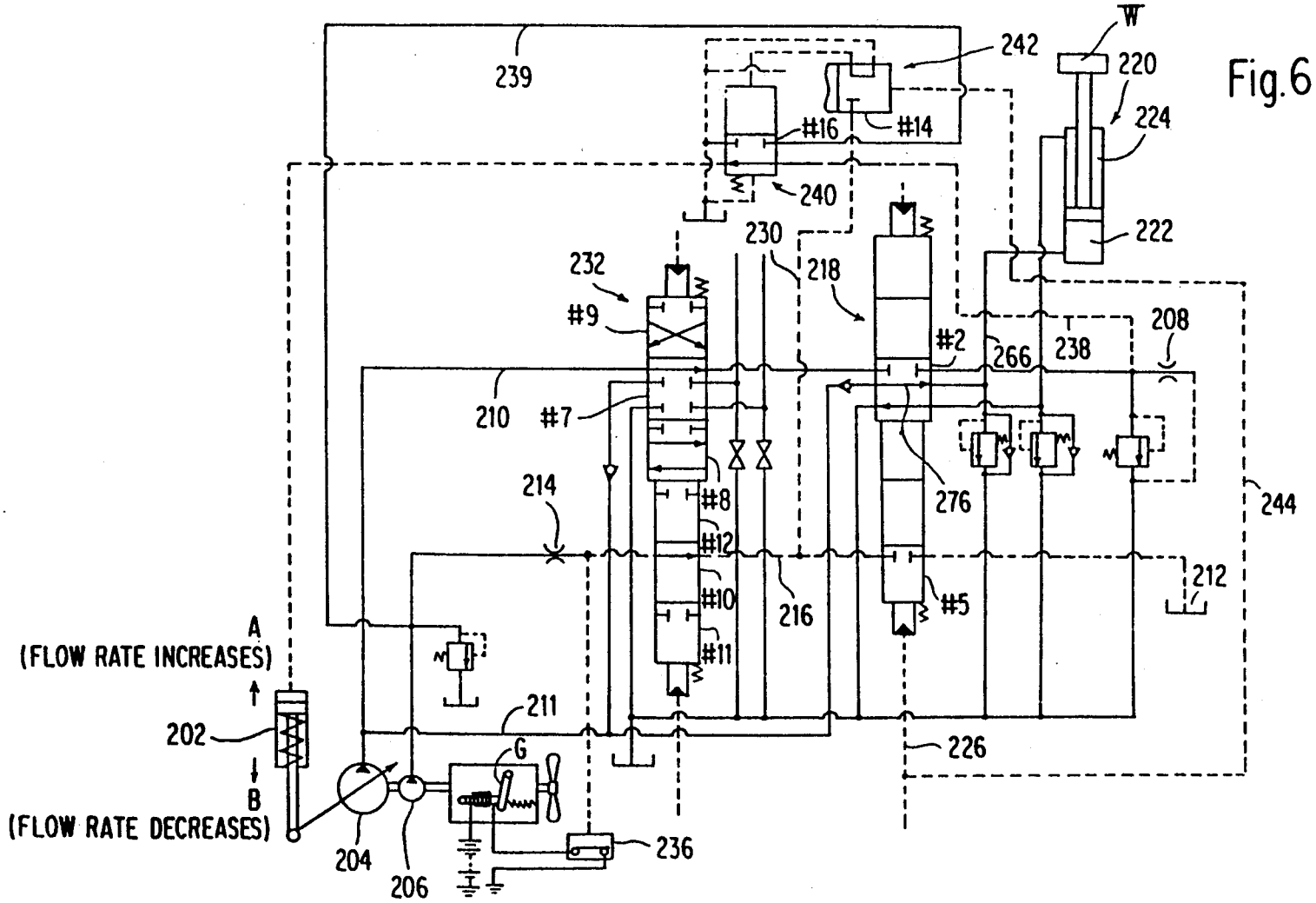

Described below with reference to FIGS. 4 to 6 is another embodiment of the energy regenerative circuit of the hydraulic apparatus improved according to this invention in order to achieve the second object mentioned earlier.

FIG. 4 illustrates a portion of the energy regenerative circuit in the hydraulic apparatus adapted, for example, to the excavator shown in FIG. 7. In FIG. 4, provision is made of a variable displacement pump 204 whose discharge rate is controlled by a capacity control mechanism 202, and a pilot pump 206. These pumps are driven by an engine E.

The variable displacement pump 204 is connected to a fluid tank 212 via a by-pass fluid line 210 that has a signal orifice 208. The pilot pump 206 is connected to the fluid tank 212 via an autodeceleration signal fluid line 216 formed on the downstream side of the orifice 214. A direction control valve 218 is provided on the upstream side of the signal orifice 208 of by-pass fluid line 210 and on the downstream side of the orifice 214 of autodeceleration signal fluid line 216 to open and close them simultaneously. The direction control valve 218 opens the above two fluid lines when it is at its neutral position, and closes them when it is in operation.

The direction control valve 218 controls an actuator 220 which, in this case, consists of a boom cylinder C3 that has a loaded-side chamber 222 on the side of piston head and an unloaded-side chamber 224 on the side of piston rod. The piston rod supports the load W of the operation device S such as boom B and the like. The load W acts on the loaded-side chamber 222 as load-holding pressure (when the operation device S is above the ground).

The direction control valve 218 is changed over for its position by the secondary pilot pressure of a pressure-reducing valve that is not shown but that is connected to a loaded-side chamber pilot fluid line 226 and an unloaded-side chamber pilot fluid line 228. The side for controlling the by-pass fluid line 210 of the direction control valve 218 consists of a 6-port 3-position change-over valve that can be changed over to a neutral position designated at #1 in FIG. 4, to an actuator loaded-side chamber acting position designated at #2 and to an actuator unloaded-side chamber acting position designated at #3. The side for controlling the autodeceleration signal fluid line 216 consists of a 2-port 3-position change-over valve that can be changed over to a neutral position designated at #4 in FIG. 4, to an actuator loaded-side chamber acting position designated at #5 and to an actuator unloaded-side chamber acting position designated at #6.

Another direction control valve 232 is provided on the upstream side of the direction control valve 218 of the by-pass fluid line 210 and on the upstream side of an autodeceleration pressure signal fluid line 230 that will be described later of the autodeceleration signal fluid line 216, in order to close both of these fluid lines when it is at its neutral position and to close them when it is at its operation position. The another direction control valve 232 for controlling another actuator is changed over for its position based on the secondary pilot pressure of another pressure-reducing valve. The side for controlling the by-pass fluid line 210 of the another direction control valve 232 consists of a 6-port 3-position change-over valve that can be changed over to a neutral position #7, and to operation positions #8 and #9. The side for controlling the autodeceleration signal fluid line 216 consists of a 2-port 3-position change-over valve that can be changed over to a neutral position #10, and to operation positions #11 and #12. The pressure-reducing valves for controlling the direction control valves 218 and 232 are controlled by an operation lever provided in the cab.

When the direction control valves 218 and 232 are operated, the variable displacement pump 204 is connected to the direction control valves 218 and 232 through main fluid line 211, such that the discharge pressure of the variable displacement pump 204 can be fed to the actuators thereof.

A pressure switch 236 is connected to the autodeceleration signal fluid line 216 via signal fluid line 234. The pressure switch 236 is turned on when the autodeceleration signal fluid path 216 is closed by the direction control valves 218 and 232, and is turned off when the autodeceleration signal fluid line 216 is opened. When the pressure switch 236 is turned on, the operation magnet M of governor lever G of the engine E is excited, and the governor lever G is moved to the position of a rated speed. When the pressure switch 236 is turned off, the magnet M is de-energized, and the governor lever G is moved to the position of a low speed.

The upstream side of signal orifice 208 of the by-pass fluid line 210 and the capacity control mechanism 202 are connected together through by-pass pressure signal fluid line 238. Further, the pilot pump 206 and the capacity control mechanism 202 are connected together through pilot pressure transfer fluid line 239. The capacity control mechanism 202 consists of a capacity control cylinder which is controlled to move toward the direction of a small flow rate indicated by arrow B when the hydraulic pressure that is fed is great and to move toward the direction of a large flow rate indicated by arrow A when the hydraulic pressure is small.

The bypass pressure signal fluid line 238 and pilot pressure transfer fluid line 239 are opened and closed by the first pilot valve 240. The pilot port side of the first pilot valve 240 is connected to the upstream side of the direction control valve 218 of the autodeceleration signal fluid line 216 via autodeceleration pressure signal fluid line 230 which is opened and closed by the second pilot valve 242. The pilot port side of the second pilot valve 242 is connected to the loaded-side chamber pilot fluid line 226 of the direction control valve 218 via pilot pressure signal fluid line 244. When the pilot pressure acts on the pilot pressure signal fluid line 244, the second pilot valve 242 closes the autodeceleration pressure signal fluid line 230 (position designated at #14 in FIG. 4) and opens this fluid line (position designated at #13 in FIG. 4) when no pilot pressure acts thereon.

The second pilot valve 242 consists of a 3-port 2-position change-over valve and has an internal fluid line that is so constituted that when a position #13 is assumed to open the autodeceleration pressure signal fluid line 230, this fluid line 230 is connected to the pilot port side of the first pilot valve 240 via a fluid line 246 and is further connected to the fluid tank 212 via another branch fluid line 250 that has an orifice 248.

The first pilot valve 240 consists of a 4-port 2-position change-over valve which opens the by-pass pressure signal fluid line 238 at a position designated at #16 and further closes the pilot pressure transfer fluid line 239. At the position #15, furthermore, the first pilot valve 240 closes the by-pass pressure signal fluid line 238 and opens the pilot pressure transfer fluid line 239. The first pilot valve 240 has an internal fluid line that is so constituted that at the position where the pilot pressure transfer fluid line 239 is opened, the pilot pressure transfer fluid line 239 is connected to the fluid tank 212 via a fluid line 256 that has two orifices 252 and 254, and is further connected to the capacity control mechanism 202 via by-pass pressure signal fluid line 238 and fluid line 258 that is branched from between the two orifices 252 and 254 of the fluid line 256.

Described below are the constitution and action of the hydraulic circuit at each of the positions of the direction control valve 218.

Neutral Position

The direction control valve 218 assumes the positions designated at #1 and #4 in FIG. 4 in the by-pass fluid line 210 and autodeceleration signal fluid line 216. The another direction control valve 232 is presumed to remain at the neutral position.

The by-pass fluid line 210 and the autodeceleration signal fluid line 216 are both opened.. The pressure switch 236 is turned off and the governor lever G is at the low-speed position. The second pilot valve 242 opens the autodeceleration pressure signal fluid line 230 at the position #13 of FIG. 4. However, since the autodeceleration pressure is low, the first pilot valve 240 assumes the position #16 to close the pilot pressure transfer fluid line 239 and to open the by-pass pressure signal fluid line 238. Discharge pressure of the variable displacement pump 204 is fed to the capacity control mechanism 202 via by-pass pressure signal fluid line 238. At the neutral position, therefore, the hydraulic pressure fed to the by-pass pressure signal fluid line 238 becomes the greatest due to the function of the signal orifice 208 and the discharge rate of the variable displacement pump 204 becomes the smallest. No pressurized fluid is fed to the actuator 220.

Actuator Unloaded-Side Chamber Acting Position

(When Boom is Lowered Due to Its Own Weight)

The secondary pilot pressure acts on the direction control valve 218 from the pressure-reducing valve that is not shown via unloaded-side chamber pilot fluid line 228; i.e., the direction control valve 218 is changed over to the positions designated at #3 and #6 in the by-pass fluid line 210 and autodeceleration signal fluid line 216 as shown in FIG. 5.

The by-pass fluid line 210 and autodeceleration signal fluid line 216 are both closed. The pressure switch 236 is turned on, and the governor lever G is shifted to the position of the rated speed. The second pilot valve 242 at the position #13 of FIG. 5 opens the autodeceleration pressure signal fluid line 230 but the autodeceleration signal fluid line 216 remains closed. Due to the function of the orifice 248 of branch fluid line 250, furthermore, the autodeceleration pressure rises and the first pilot valve 240 is switched to the position #15. The by-pass pressure signal fluid line 238 is closed and the pilot pressure transfer fluid line 239 is opened. To the capacity control mechanism 202 are transferred the pressure of pilot pressure transfer fluid line 239 of the pilot pump 206 and a medium pressure that is determined by an opening ratio of the orifices 254 and 252 of the fluid line 256. Therefore, the variable displacement pump 204 is controlled to a medium dicharge rate.

The pressurized fluid discharged from the thus controlled variable displacement pump 204 is fed to the unloaded-side chamber 224 of the actuator 220 via main fluid line 211, internal fluid line 262 having orifice 260 in the direction control valve 218, and fluid line 264.

The load-holding fluid in the loaded-side chamber 222 whose pressure is elevated by the action of load W of the operation device S is fed to another internal fluid line 268 in the direction control valve 218 via fluid line 266. After fed to the another internal fluid line 268 the load-holding pressurized fluid is returned to the fluid tank 212 via the orifice 270 provided for the internal fluid line 268 and return fluid line 246. The load-holding pressurized fluid is further partly fed to the unloaded-side chamber 224 of the actuator 220 via check valve 274 of a further internal fluid line 272 and fluid line 264.

Therefore, the boom B, i.e. the operation device S, is allowed to descend.

Actuator Unloaded-Side Chamber Acting Position

(During the Compacting Operation)

After the boom is lowered and grounded, the pressurized fluid may often be fed to the unloaded-side chamber 224 of the actuator 220 in order to compact the ground by the operation device.

When the boom is lowered and grounded, the unloaded-side chamber 224 is converted into the loaded side. The hydraulic pressure in the loaded-side chamber 222 is so lowered as to become equal to the line pressure of the fluid tank 212, and no pressurized fluid is fed to the unloaded-side chamber 224. The variable displacement pump 204 is maintained under a medium discharge rate condition. However, since the by-pass fluid line 210 is closed, the pressurized fluid is fed to the unloaded-side chamber 224 stably and continuously.

Actuator Loaded-Side Chamber Acting Position

The secondary pilot pressure acts on the direction control valve 218 from the pressure-reducing valve that is not shown via loaded-side chamber pilot fluid line 226; i.e., the direction control valve 218 is changed over to the positions #2 and #5 in the by-pass fluid line 210 and autodeceleration signal fluid line 216.

The by-pass fluid line 210 and the autodeceleration signal fluid line 216 are both closed. The pressure switch 236 is turned, and the governor lever G is shifted to the position of the rated speed. The second pilot valve 242 receives the secondary pilot pressure via pilot pressure signal fluid line 244, and is changed over to a position #14 of FIG. 6 to close the autodeceleration pressure signal fluid line 230. The first pilot valve 240 is changed over to a position #16, whereby the by-pass pressure signal fluid line 238 is opened and the pilot pressure transfer fluid line 239 is closed. Though the by-pass pressure signal fluid line 238 is opened, the by-pass fluid line 210 is closed by the direction control valve 218 and the hydraulic pressure in the by-pass pressure signal fluid line 238 becomes equal to the tank pressure. The variable displacement pump 204 is controlled to exhibit its maximum discharge rate.

The pressurized fluid discharged from the variable displacement pump 204 is fed to the loaded-side chamber 222 of the actuator 220 via main fluid line 211, internal fluid line 276 of the direction control valve 218 and fluid line 266.

Therefore, the boom B, i.e. the operation device S, ascends.

Operation Position of Another Direction Control Valve

When the another direction control valve 232 is changed over to the operation positions #9 and #12 or #8 and #11 with the direction control valve 218 under any of the above-mentioned conditions, the by-pass fluid line 210 is closed on the upstream side of the orifice 208 and the autodeceleration signal fluid line 216 is closed on the upstream side of the autodeceleration pressure signal fluid line 230. Therefore, at the neutral position of the direction control valve 218 of FIG. 1 at which the by-pass pressure signal fluid line 238 is opened by the first pilot valve 240 and at the loaded-side chamber acting position of FIG. 6, the hydraulic pressure in the by-pass pressure signal fluid line 238 becomes equal to the tank pressure and the variable displacement pump 204 is controlled to exhibit the greatest discharge rate.

At the unloaded-side chamber acting position of the direction control valve 218 of FIG. 5, furthermore, the pressurized fluid of the autodeceleration pressure signal fluid line 230 escapes into the fluid tank 212 via branch fluid line 250 that has the orifice 248 of second pilot valve 242. Therefore, the first pilot valve 240 is changed over to the position #16 of FIG. 4. The hydraulic pressure in the by-pass pressure signal fluid line 238 becomes equal to the tank pressure, and the variable displacement pump 204 is controlled to exhibit the greatest discharge rate.

When the another direction control valve 232 is at the operation positions, the pressure switch 236 is turned on, and the governor lever G is shifted to the position of the rated speed.

The following effects are obtained by the energy regenerative circuit of the hydraulic apparatus that is improved according to this invention in order to accomplish the second object mentioned earlier.

(1) When the direction control valve is at the actuator unloaded-side chamber acting position (the boom, i.e. the operation device, is lowered due to its own weight), the by-pass pressure signal fluid line is closed, and the discharge pressure of the pilot pump is controlled and is fed to the capacity control mechanism of the variable displacement pump. Therefore, the variable displacement pump exhibits a medium discharge rate, making it possible to save the energy. Moreover, a highly pressurized fluid which is part of the load-holding pressurized fluid of the loaded-side chamber is fed to the unloaded-side chamber of the actuator, and the operation device is permitted to descend sufficiently due to its own weight, and no vacuum condition develops in the unloaded-side chamber.

Therefore, it is allowed to effectively regenerate the load-holding pressure in the loaded-side chamber, and to save the energy to a striking degree without decreasing the descending speed of the actuator.

(2) Even when the operation device is shifted to the compacting operation under the condition where the direction control valve is at the unloaded-side chamber acting position of the actuator, the pressurized fluid discharged from the variable displacement pump is fed to the unloaded-side chamber of the actuator stably and continuously since the by-pass fluid line has been closed from the first. It is therefore allowed to quickly cope with the compacting operation.

(3) The another direction control valve is provided to open, when it is at the neutral position, the by-pass fluid line on the upstream side of the direction control valve and to open the autodeceleration signal fluid line on the upstream side of the autodeceleration pressure signal fluid line and to close them when it is at its operation positions. When the another direction control valve is at its operation positions, therefore, the variable displacement pump exhibits the greatest discharge rate to fully assure the operation speed of the another actuator. The same also holds true even when the direction control valve is at the loaded-side chamber acting position of the actuator.

(4) Moreover, since the autodeceleration signal fluid line is closed when the direction control valve is at its operation positions, the governor lever of the engine is shifted to the position of the rated speed to properly cope with the operation of the actuator.

Though this invention was described above in detail by way of embodiments, it should be noted that the invention is in no way limited to the above embodiments only but can be varied or modified in a variety of other ways without departing from the scope of the invention.

What we claim is:

1. An energy regenerative circuit of a hydraulic apparatus, wherein:

a variable displacement pump controlled by a capacity control mechanism is connected to a fluid tank via a by-pass fluid line and a pilot pump is connected to said fluid tank via an autodeceleration signal fluid line;

the upstream side of orifice of said by-pass fluid line and the downstream side of orifice of said autodeceleration signal fluid line are controlled to be opened or closed when a direction control valve that controls an actuator is at its neutral position or at its operation positions;

the upstream side of said signal orifice of said by-pass fluid line and said capacity control mechanism are connected together via a by-pass pressure signal fluid line, and said pilot pump and said capacity control mechanism are connected together via a pilot pressure transfer fluid line;

a first pilot valve is provided to open and close said by-pass pressure signal fluid line and said pilot pressure transfer fluid line;

said first pilot valve is connected at its pilot port side to the upstream side of said direction control valve of said autodeceleration signal fluid line via an autodeceleration pressure signal fluid line that is opened and closed by a second pilot valve;

said first pilot valve closes said by-pass pressure signal fluid line and opens said pilot pressure transfer fluid line when said direction control valve is at the unloaded-side chamber acting position but only when said autodeceleration pressure signal fluid line is opened by said second pilot valve; and when said direction control valve is at the unloaded-side chamber acting position, the loaded-side chamber of said actuator is so connected that the pressurized fluid thereof is partly added through said direction control valve to the fluid line through which the pressurized fluid discharged from said variable displacement pump is partly fed to said unloaded-side chamber.

2. An energy regenerative circuit of a hydraulic apparatus according to claim 1, wherein provision is made of another direction control valve which when it is at its neutral position or at its operation positions, opens or closes said by-pass fluid line on the upstream side of said direction control valve and said autodeceleration signal fluid line on the upstream side of said autodeceleration pressure signal fluid line.

* * * * *